US010166581B2

(12) United States Patent
Cernuschi et al.

(10) Patent No.: US 10,166,581 B2
(45) Date of Patent: Jan. 1, 2019

(54) INTEGRATED TRANSVERSE ROLLING MILL FOR SEAMLESS TUBES

(71) Applicant: Danieli & C. Officine Meccaniche S.p.A., Buttrio (IT)

(72) Inventors: Ettore Cernuschi, Castelletto Sopra Ticino (IT); Corrado Belluco, Castano Primo (IT); Fabrizio Marini, Cinisello Balsamo (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 463 days.

(21) Appl. No.: 14/784,500

(22) PCT Filed: Apr. 17, 2014

(86) PCT No.: PCT/IB2014/060794
§ 371 (c)(1),
(2) Date: Oct. 14, 2015

(87) PCT Pub. No.: WO2014/170857
PCT Pub. Date: Oct. 23, 2014

(65) Prior Publication Data

US 2016/0059285 A1 Mar. 3, 2016

(30) Foreign Application Priority Data

Apr. 17, 2013 (IT) ..... MI2013A0628

(51) Int. Cl.
*B21B 19/04* (2006.01)
*B21B 19/10* (2006.01)
*B21B 23/00* (2006.01)

(52) U.S. Cl.
CPC ..... *B21B 19/04* (2013.01); *B21B 23/00* (2013.01); *B21B 19/10* (2013.01)

(58) Field of Classification Search
CPC ..... B21B 19/02; B21B 19/04; B21B 19/06; B21B 19/08; B21B 19/10; B21B 17/02; B21B 17/06; B21B 23/00
See application file for complete search history.

(56) References Cited

U.S. PATENT DOCUMENTS 401,143 A * 4/1889 Flagler ..... B21B 19/04 72/97
401,145 A 4/1889 Flagler
(Continued)

FOREIGN PATENT DOCUMENTS

DE 259623 6/1911
DE 102005052178 4/2016
(Continued)

*Primary Examiner* — Pradeep C Battula
(74) *Attorney, Agent, or Firm* — Stetina Brunda Garred & Brucker

(57) ABSTRACT

An integrated transverse rolling mill for rolling seamless tubes with skewed axes comprising a piercing stand (2) with skewed axis rolling rolls for piercing a first tube (7) having a first length which is shorter than the space which separates it from the subsequent finishing stand (3) in cooperation with the stake (6), which has the first piercing tip (20) at its end and the second finishing tip (21) at the finishing stand (3). The finishing stand (3) is arranged downstream of the piercing stand (2) so that during the rolling operations the front end of the first tube (7) may only be gripped by the finishing stand (3) once the rear end of the first tube (7) is no longer gripped by the rolling stand (2).

12 Claims, 7 Drawing Sheets

(56) References Cited

U.S. PATENT DOCUMENTS

| | | | | |
|---|---|---|---|---|
| 4,771,624 | A | 9/1988 | Vorbach et al. | |
| 9,789,522 | B2 * | 10/2017 | Hoeffgen ..... | B21B 17/02 |

FOREIGN PATENT DOCUMENTS

| | | |
|---|---|---|
| EP | 1764167 | 3/2007 |
| GB | 191029982 | 4/1911 |
| GB | 2081152 | 2/1982 |
| SU | 1733131 | 5/1992 |

* cited by examiner

INTEGRATED TRANSVERSE ROLLING MILL FOR SEAMLESS TUBES

CROSS REFERENCE TO RELATED APPLICATIONS

The present application claims priority to PCT International Application No. PCT/IB2014/060794 filed on Apr. 17, 2014, which application claims priority to Italian Patent Application No. MI2013A000628 filed Apr. 17, 2013, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to the production of seamless rolled tubes from full-section billets. In particular, the invention relates to an integrated transverse rolling mill.

STATE OF THE ART

Seamless tube rolling operations are generally carried out in three steps: the step of piercing, the step of rolling proper (also named finishing) and the step of calibrating to the final required diameter.

According to a first known operating method, the step of piercing of a product to be rolled is carried out in a system dedicated solely for this purpose, i.e. different from the system where the rolling is carried out. With this regard, patents U.S. Pat. No. 401,145 and EP1764167 describe rolling mills intended for making seamless tubes starting from a product to be rolled which has been previously pierced. Substantially, no equipment for piercing the product to be rolled is provided in such rolling mills because the product arrives already pierced at the rolling mill inlet.

More specifically, U.S. Pat. No. 401,145 describes a rolling mill comprising two rolling stands in series. In the first stand, the rolling is carried out by means of conical rolls with skewed horizontal axes which operate on a first inner tip mounted on the end of a first stake inserted and supported on the loading side of the pierced tube. In the second stand, the rolling is carried out by means of two concave transverse rolls with skewed horizontal axes which operate on a second outer tip mounted on the end of a second stake inserted and supported on the outlet side of the pierced tube. In U.S. Pat. No. 401,145, the first rolling stand is configured to cause a first elongation by operating on the inner fibers, while the second rolling stand is configured to complete the elongation by operating on the inner fibers.

Unlike the previous solutions, in some rolling mills the step of the piercing is carried out in the scope of transverse rolling with a rolling mill having skewed axis rolls operating on an inner ogive-shaped tool, named tip. The subsequent step of rolling is carried out on rolling mills of the multiple stand longitudinal type with two or three rolls per stand operating on mobile mandrel, or on transversal type rolling mills with two or three rolls operating on tip tool or on mobile mandrel.

The latter rolling mills belong to the Assel, Accu Roll, Diescher, rotary expander type rolling mills, and on both the longitudinal or transversal rolling mill types the machining speed is entirely independent from the speed of the piercing stand which precedes them on the machining line.

This independence of operation is a direct consequence of the transversal loading of the product to be rolled which is used at the finishing rolling mill inlet and at the piercing stand outlet. A consequence of this is that the two rolling mills (the piercing and the finishing rolling mills) are arranged consecutively along parallel, not coincidental rolling axes. The transfer of the part to be rolled from the piercing mill stand to the finishing mill stand arranged spaced apart and offset causes several problems due to the time employed for this transfer, during which fresh air is sucked into the pierced element, so that oxygen reacts with the incandescent metal forming harmful oxides for the subsequent rolling and for the end quality of the rolled tubes. A rolling mill of the prior art, which shows a piercing stand followed by a longitudinal rolling mill operating on mandrel, is illustrated in FIG. 3.

Obviously, in addition to internal oxidation, there is an accentuated cooling of the pierced part, which phenomenon is detrimental for the subsequent rolling quality.

The arrangement of the piercing stand and of the finishing stand with distanced, offset parallel axes implies that the span on the shed which houses the tube rolling system must be very wide, typically from at least 33 to 42 meters, which implies high investment and management costs of the entire system.

SUMMARY OF THE INVENTION

It is the main object of the present invention to provide an integrated rolling mill for seamless tubes which is more cost-effective than those most common today, reducing the investment cost from both the constructive and the operating point of view.

These and other objects are reached by means of a transverse rolling mill for rolling seamless tubes, defining a first rolling axis, comprising a piercing stand having rolling rolls with respective skewed axes, having a rolling axis thereof coinciding with said first rolling axis, adapted to produce a first tube having a first rolled product length after the piercing operation of a billet, at least one finishing stand having rolling rolls with respective skewed axes, having a rolling axis thereof coinciding with said first rolling axis, adapted to produce a second tube, starting from the first tube, having a second rolled product length after a finishing operation of the first tube, the at least one finishing stand being arranged downstream of the piercing stand at a distance not smaller than the length of the first rolled product, so that during the rolling operations the front end of the first tube may only be picked by the finishing stand once the rear end of the first tube is no longer gripped by the rolling stand.

The rolling mill comprises at least one stake provided with an end tip adapted to pierce and roll the billet, a first portion having a length greater than the length of the first rolled product, an intermediate tip, adapted to roll the first tube to transform it into a second tube, and a second portion having a length greater than the length of the second rolled product. In particular, according to the invention, the same stake is used for the piercing operation on the piercing stand and also for the finishing operation on the finishing stand.

By virtue of the solution of the rolling mill of the invention, the initial construction costs and the operating costs are both considerably reduced. Indeed, the machinery needed for the operation of the rolling system is simplified and construction costs are reduced. Furthermore, the installation costs may also be reduced in terms of civil works, e.g. by making smaller excavations and foundations, and of construction of the shed, e.g. by reducing its height and particularly the width of the spans. Not less important are the savings that are obtained, for example, by using smaller size auxiliary systems; indeed, shorter, and cheaper bridge cranes may be used by reducing the width of the spans, for example. The total weight of the shed structure is reduced, with positive repercussions on global cost.

The rolling mill of the invention achieves an advantage of great importance consisting in incorporating the first two deformation stages of the rolling product, i.e. the piercing stage and the finishing rolling, on a common, single rolling axis. These two stages are distanced apart only by a distance which is only slightly greater than the length of the pierced product. This feature overcomes many disadvantages of the tube rolling mills of the prior art, which does not disclose transversal type rolling mills with rolling stands fitted along the same rolling axis.

The word "integrated" means a rolling mill in which the step of piercing and of finishing rolling are carried out in rapid sequence on the rolling axis itself.

The dependent claims refer to preferred embodiments of the invention.

BRIEF DESCRIPTION OF THE FIGURES

Further features and advantages of the present invention will be apparent in the light of the detailed description of a preferred, but not exclusive, embodiment, of a rolling mill according to the invention illustrated by the way of non-limitative example, with reference to the accompanying drawings, in which.

Equal reference numbers in the various figures correspond to the same elements or components.

DETAILED DESCRIPTION OF EMBODIMENTS OF THE INVENTION

With particular reference to the figures, a rolling mill 1, according to the invention, operates starting from a "full" product to be rolled, such as, for example, a billet 8. The word "full" means a product which after casting has not undergone any piercing operation before reaching the rolling mill 1 to be transformed into a seamless rolled tube.

Figure 1:
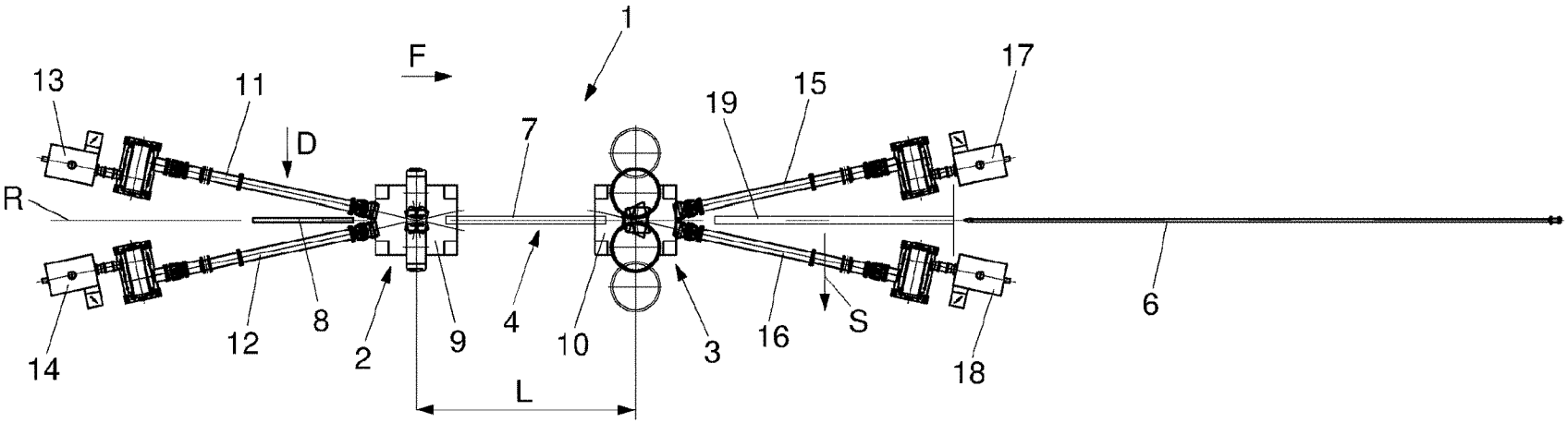
FIG. 1 shows a plan view of a rolling mill according to the invention.

The rolling mill 1 according to the present invention comprises a piercing stand 2 and a rolling stand 3, also named finishing stand, arranged in sequence along the rolling line R (hereinafter, also indicated by the expression "rolling axis R") in common to both stands 2 and 3. The stands 2 and 3 are of the transverse rolling type, i.e. of the type having rolling rolls arranged with the axes thereof skewed with respect to the axis of the tube 8 to be rolled. The piercing stand 2 has two vertical working rolls, i.e. arranged one over and one under the rolling axis R, two side guides of the fixed, or possibly disc, type, a guide triad 9 of the stake 6 fitted in the piercing stand 2 on the tube outlet side. The control adapters 11, 12 and related motors 13, 14 of the piercing stand 2 are mounted on the inlet side of the tube on the left of view shown in FIG. 1. The stake 6 comprises at least one end tip 20, which has the function of piercing the full-section billet and of rolling it by cooperating with the rolling roll of the piercing stand 2.

The finishing stand 3 placed immediately downstream of the piercing stand 2, has two vertical work rolls, i.e. arranged over and under the rolling axis R, two disc type side guides, a guiding triad 10 of the stake 6 fitted inside the finishing stand 3 on the inlet side. The control adapters 15,16 and the related motors 17,18 are fitted on outlet side. Preferably, the finishing stand 3 is identical to the first piercing stand 2, but rotated by 180° about the vertical axis of the stand itself so that the control adapters 15, 16 and the related motors 17, 18 of the finishing stand 3 are arranged on the opposite side of the zone that separates the piercing stand 2 from the finishing stand 3, thus forming, when seen from above, an X-shaped arrangement.

In an arrangement like the one in this embodiment, the billet 8 is loaded onto the piercing stand 2 from the right, i.e. in the direction of the arrow D, and is unloaded from the finishing stand 3 from the left, i.e. in the direction of the arrow S, commonly said S-shaped arrangement. In a case like this, the stake 6 always turns clockwise during both piercing and finishing rolling, taking as reference an observer looking at the tube which is being rolled from the position upstream of the rolling mill.

A reversed arrangement may be chosen in which the billet 8 is loaded to the piercing stand 2 from the left and unloaded from the finishing stand on the right, according to the so-called Z-arrangement. In this case, the stake always turns counterclockwise during both the first and the second rolling.

The rolling in the finishing stand 3 preferably occurs on an intermediate tip 21 mounted in an intermediate zone of the stake 6. Alternatively, this type of rolling may be replaced by a rolling on a cylindrical mandrel, by inserting devices adapted to produce an axial movement of the mandrel itself. In this variant, the mandrel must work in compression and not in traction.

In general, unlike the traditional type solutions, according to the invention, the same stake is used for the piercing operation on the piercing stand 2 and for the finishing operation on the finishing stand 3. The stake 6 is also supported by the outlet side of the finished rolled product (indicated by reference 19 in FIG. 1), i.e. by the outlet side of the finishing stand 3. An advantage of the integrated rolling on the same rolling axis is that the amount of air entering the pierced product is limited, being the stake 6 inside the pierced product between piercing and rolling, and thus deoxidizing systems of the pierced product and inner tool lubrication systems are no longer needed, with advantage of production cost-effectiveness and absence of fumes generated by the combustion of the deoxidizing and lubricating products.

In general, in the rolling mill 1 according to the invention, the operating sequence thus includes a piercing and a first elongation of the full-section billet 8 (by means of the end tip 20) at the piercing stand 2 so as to obtain a pierced tube (indicated by reference numeral 7 for the sake of clarity) and a subsequent elongation of such a pierced tube 7 on the finishing stand 3. Thus, as a whole, the piercing stand 2 operates firstly on the inner fibers of the full-section billet 8 piercing and obtaining a first elongation of it. The finishing stand 3 operates on the outer fibers of the pierced tube 7, instead, causing a second elongation which ends with the rolled tube (indicated by reference numeral 19 in FIG. 1).

In addition to the stands 2 and 3 indicated above, the rolling mill 1 also comprises an inlet section (not shown) arranged upstream of the piercing stand 2, of traditional type, consisting of an open channel and a closed end part, named cannon or cannon barrel, which guides the billet to the first stand. A pusher device, e.g. hydraulically or electromechanically controlled, is also provided to push the billet 8 between the working rolls of the piercing stand 2.

An intermediate section 4 of the rolling mill 1 is located downstream of the piercing stand 2 and before the finishing stand 3. Such an intermediate section 4 performs the tasks of guiding the stake 6 by centering it on the rolling axis R by means of one or more guiding triads (not shown) to support and handle the pierced product at the outlet of the piercing stand 2 to feed the rolling stand 3, possibly with helical motion. Such a function may be implemented by a retractable skewed roller bed and an upper presser roll, or, possibly, by one or more pairs of counterpoised skewed motorized rolls arranged on the left and the right of the rolling axis R. The intermediate section 4 also has the purpose of creating a space between the piercing stand 2 and the rolling stand 3, needed for maintenance of the stands themselves and of the devices fitted on them.

The rolling mill 1 normally, but not necessarily further comprises a calibration stand operatively arranged downstream of the finishing stand 3. Such a calibration stand, also said calibrating rolling mill, is not shown in the figures and may be of the known type. Such a rolling mill may be arranged on an axis parallel to the rolling axis R. An outlet section is also provided for unloading the rolled tube which has guiding triads and a motorized retractable roller bed.

Once the finishing rolling is finished, the stake 6 is moved towards the outlet side and the tube is displaced axially on the outlet side, and once the stake 6 is pulled out from the tube, a system, for example of the rotating arm type, laterally transfers the tube to prepare for the third final step of calibrating.

An axial actuating device of the stake 6, which is achieved by a carriage which moves between two positions, a working position and a retracted position for unloading the tube and for replacing the stake itself, is provided. Locking means, adapted to support the axial thrust of the stake 6 itself, and adjustment means, preferably of the electromechanical type, for axially positioning the tip 20 located at the front end of the stake 6 at the piercing stand 2, and possibly the intermediate tip 21 at the finishing stand 3, are provided in the working position.

Furthermore, two double cooling stations of the tips 20 and 21 mounted on the stake 6 are provided and arranged on the two sides of the rolling line R at the retracted position of the stake 6, each consisting of two openable tunnels arranged at the two tools.

A stake change system is also provided between one rolling operation and the next of the rotating arm type. One arm unloads the stake 6, which was used for rolling a tube, at the end of the rolling cycle on the two stands, and at the same time a second arm loads the next stake, entirely equivalent to the previous one, from the cooling station on the opposite side, depositing it on the rolling axis R. Furthermore, a pre-rotation system of the stake 6, which operates in the given rolling cycle and allows to start rotating the stake before the inlet of the piercing stand 2 and before the inlet of the finishing stand 3, is provided.

These rolling mill components are known in the prior art and are not shown in the figures because their integration in the rolling mill of the invention is within the knowledge of a person skilled in the art.

The stake 6 engages at the same time, during rolling, both the piercing stand 2 and the rolling stand 3, and supports, at the same time, the tip 20 adapted to work inside the body being rolled under the piercing stand, and the intermediate tip 21 adapted to work inside the first tube 7, on the finishing stand. The stake 6 advantageously consists of two segments 6', 6" fixed to one another and which can be removed in order to replace the intermediate step 21. The connection between the two parts is achieved by means of connection systems similar to those used in the connection between the end tip 20 and the stake. These fixing systems are, for example, achieved by means of two pins, which are engaged in a groove and are reliable and guarantee a robust connection, but at the same time easy and quick to remove.

The pierced product at the outlet of the first piercing stand 2 has a length greater than the initial length of the billet 8 before being pierced, and less than the nominal distance L between the piercing stand 2 and the rolling stand 3 decreased by the physical dimensions related to the contact length between rolls and material at the outlet of the piercing stand 2 and to the contact length between rolls and material at the inlet of the rolling stand 3.

The piercing stand 2 and the finishing stand 3 are advantageously identical, only arranged in different manner, with the two vertical axis piercing stand 2 and control adapters 11,12 on the rolling product inlet side, with fixed type side guide devices or rotating disc and with the vertical type rolling stand 3 and with rotating disc guiding devices, which are more adapted to rolling long, thin bodies. The control adapters 15,16 of the rolling stand 3 are arranged on the outlet side of the rolling product of the stand itself.

Figure 2:
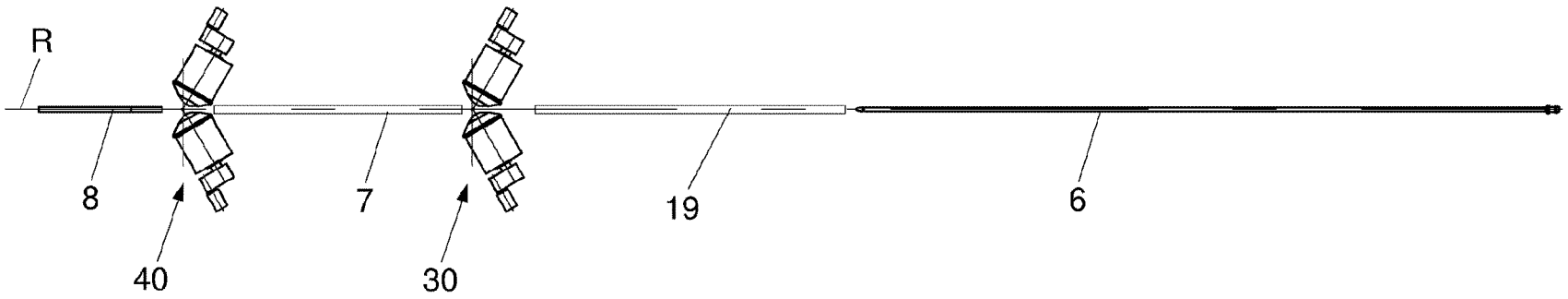
FIG. 2 shows a plan view of a different variant of the rolling mill according to the invention.
Figure 3:
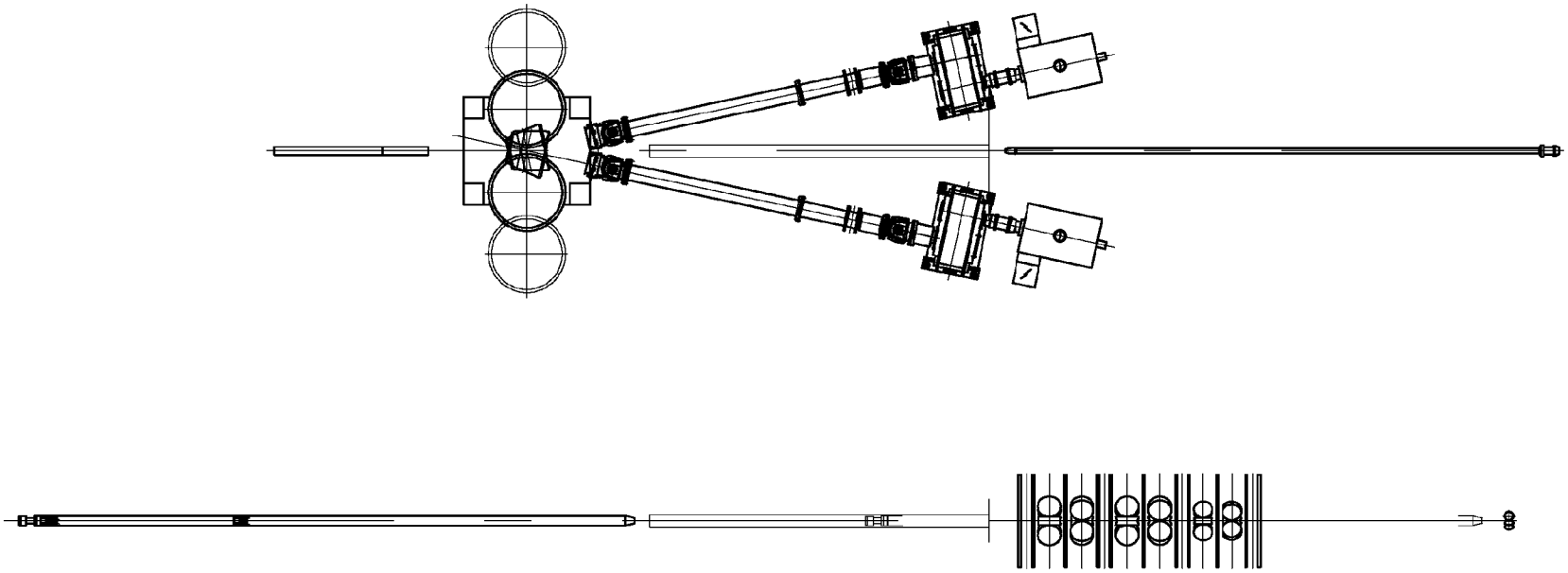
Fig. 3 (Prior Art)
FIG. 3 shows a plan view of a transversal piercing rolling mill followed by a multiple stand longitudinal rolling mill of the prior art.

In a variant of the rolling mill, shown in FIG. 2, comprising a rotating expander 30 downstream of the piercing stand 40, provided with rolls which have a high feeding degree, the piercing stand 40 and the rotating expander 30 with the adapters can be kept on the outlet side of each stand without needing to rotate the stands. Even the guiding systems in the passage from one roll to the other of each machine may be of different type.

In a further variant embodiment of the rolling mill according to the invention, both the piercing and rolling stands may have barrel-shaped rolls, with the advantage of reducing foundations and without having the height limitation typical of conical roll machines characterized by a 15° crossover angle, as commonly used in tapered roll piercing stands.

It is apparent that the stands may be of different type, e.g. with two horizontal rolls or three rolls, without because of this departing from the scope of the invention.

It is known that during transverse rolling on each stand of a transverse type rolling mill the advancement motion of the rolling material is of the helical type consisting of an axial speed vector component directed along the rolling axis and of an angular speed vector component. The value of both these speed components is determined by the rotation speed of the working rolls of each piercing stand 2 and finishing stand 3 and by the angle of the rolls of each stand with respect to the rolling axis R. A torsion of the rolling product thus occurs during the passage through each stand.

This torsion of the rolled part which occurs during the passage through the stand causes slippage between material and rolls, and would make operating in sequence with two subsequent stands of the transverse rolling type ineffective if they were to grip the same rolling part simultaneously because it would be necessary to adjust the axial speeds of the rolling rolls of the two subsequent stands with a speed control of the motors of one stand with respect to the other, e.g. by controlling the motor currents instant-by-instant. Adjusting the feeding angle of one of the two stands with a real time control would also be difficult because such a feeding angle is adjusted idly, i.e. without the part being rolled, and then such an angle is fixed by means of appropriate locking devices adapted to lock the rotation of the drums.

A typical rolling process implemented by means of the rolling mill according to the invention will be described with reference to the various steps illustrated in FIGS. from 4*a* to 4*h*.

Figure 4A:
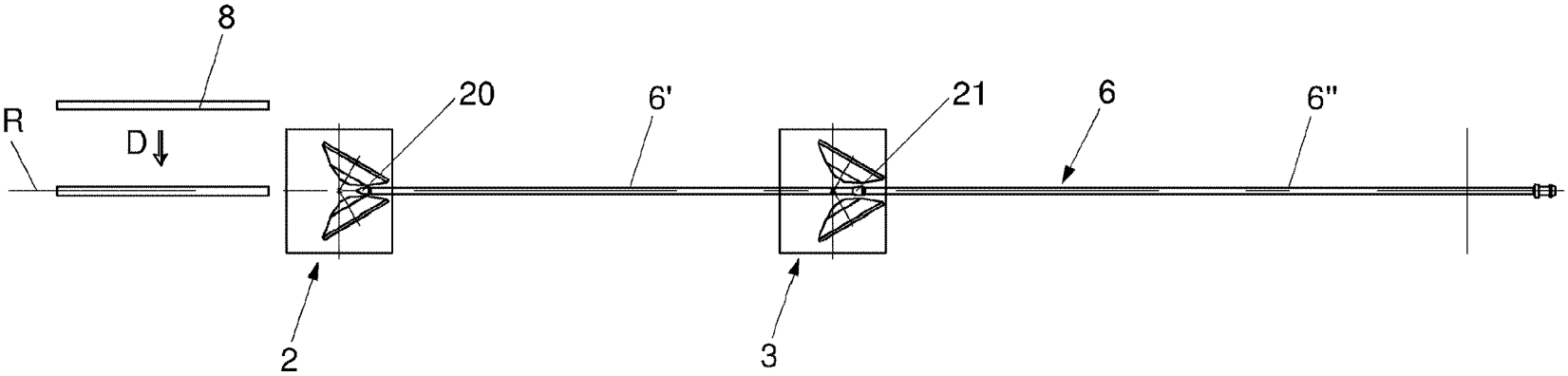
FIGS. 4*a* to 4*h* show stages of a tube rolling process implemented with the rolling mill of the invention.

FIG. 4*a* shows a stage of the process in which a metal billet 8 to be pierced and rolled is conveyed towards the rolling axis R along which is aligned with the piercing stand 2. The stake 6 was previously aligned along the rolling axis R in position so as to make the tip 20 coincide with the piercing and rolling position between the rolls of the rolling stand 2, the portion 6' of the stake 6 is arranged between the piercing stand 2 and the finishing stand 3 and the intermediate tool 21 is in the working position between the rolls of the finishing stand 3. The position 6" of the stake 6 is downstream of the finishing stand 3.

Figure 4B:
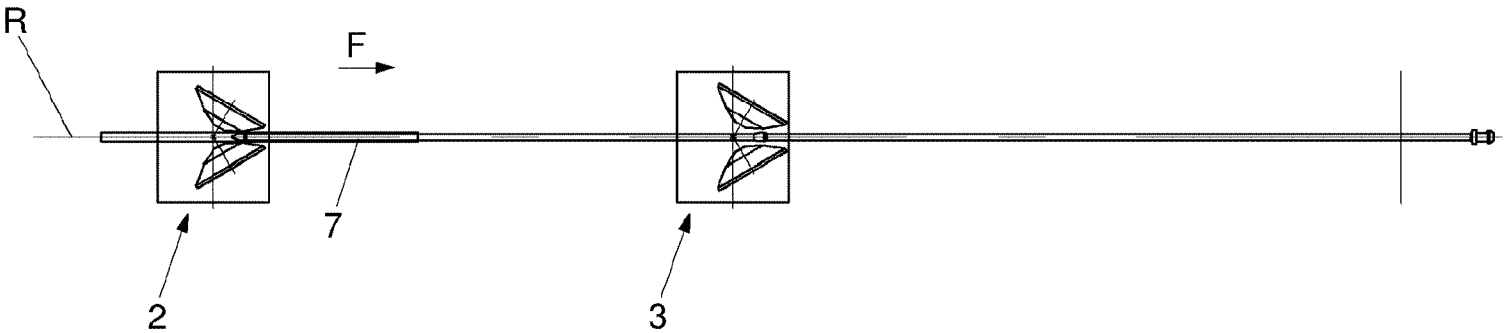

As shown in FIG. 4*b*, the billet 8 is pushed through the piercing stand 2 where it is pierced and rolled by the action of the rolls and of the tip 20, moving along the rod 6 in direction of the arrow F.

Figure 4C:
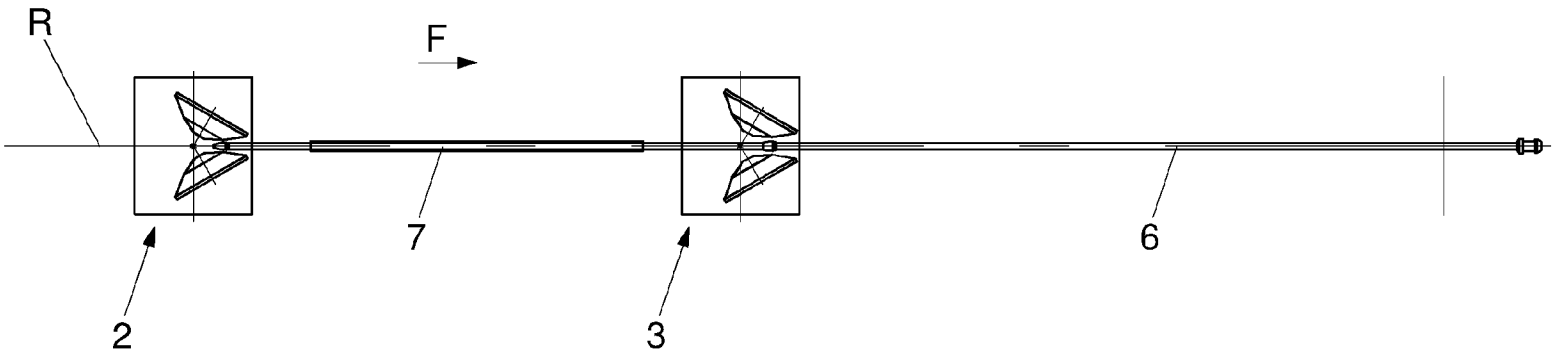
Figure 4D:
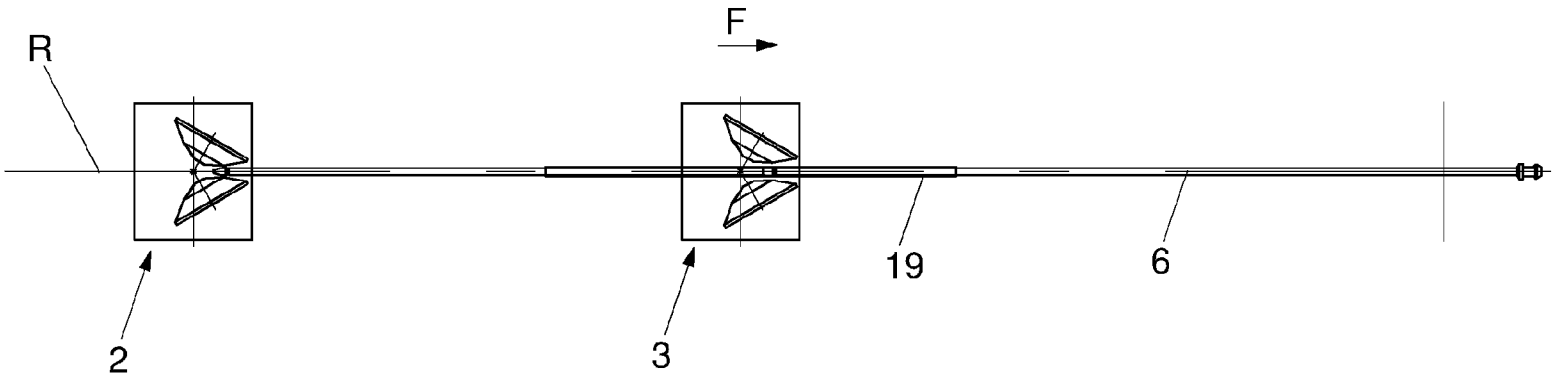

FIG. 4*c* shows the subsequent stage in which the billet 8 has become a first tube, which is indicated by reference numeral 7, pierced through and through and with a length greater than the initial length of the billet, having undergone a first rolling. FIG. 4*d* shows the first tube 7 which has continued its advancement along the stake 6 in direction of the arrow F and is pushed through the finishing stand 3 where, by means of the combined action of the rolls and the tip 21, it undergoes a second rolling said finishing rolling and also a second elongation becoming a second tube indicated by reference numeral 19 for the sake of convenience, which is longer than the first tube 7 and with thinner walls. They are called first and second tube for the sake of convenience only because they are the same elements during two subsequent machining stages.

Figure 4E:
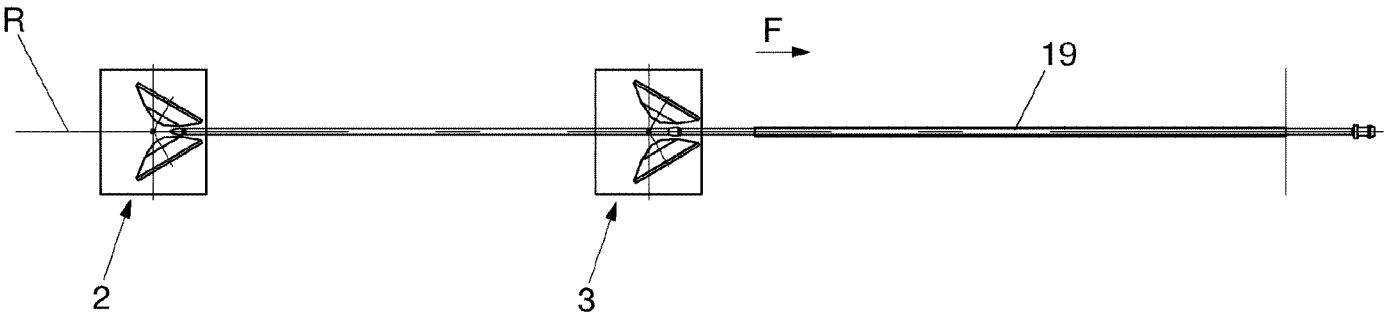
Figure 4F:
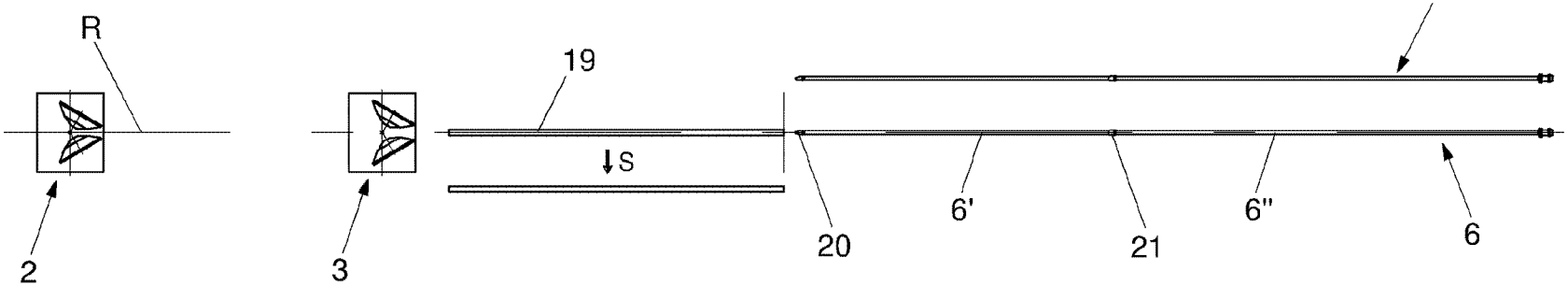

FIG. 4*e* shows the stage in which the second tube 19 has entirely exited the finishing stand and is still inserted on the stake 6. FIG. 4*f* shows the stage in which the stake 6 is pulled out from the second tube 19 and is conveyed in the cooling and lubrication device provided for the purpose but not shown. It also shows the stake 60, entirely equivalent to the stake 6 described above, which will be used for rolling the next billet during the subsequent rolling cycle. At the same time, the second tube 19 is released from the stake 6 by making it move laterally in the direction of the arrow S.

Figure 4G:
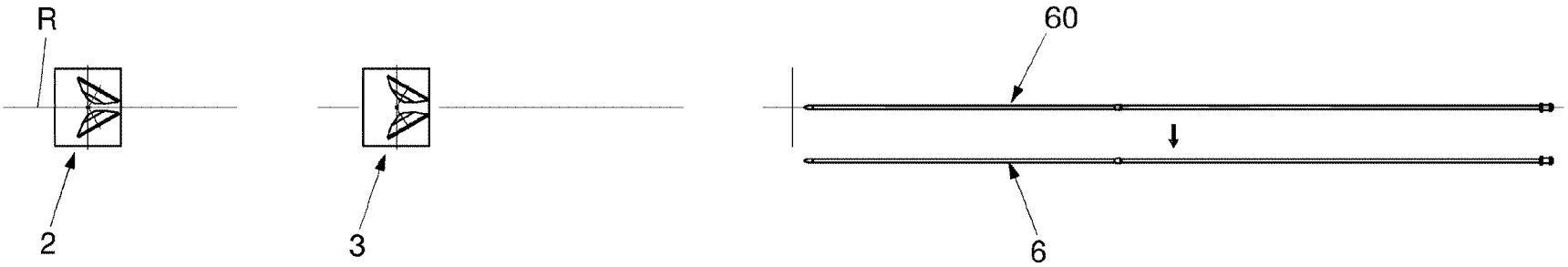
Figure 4H:
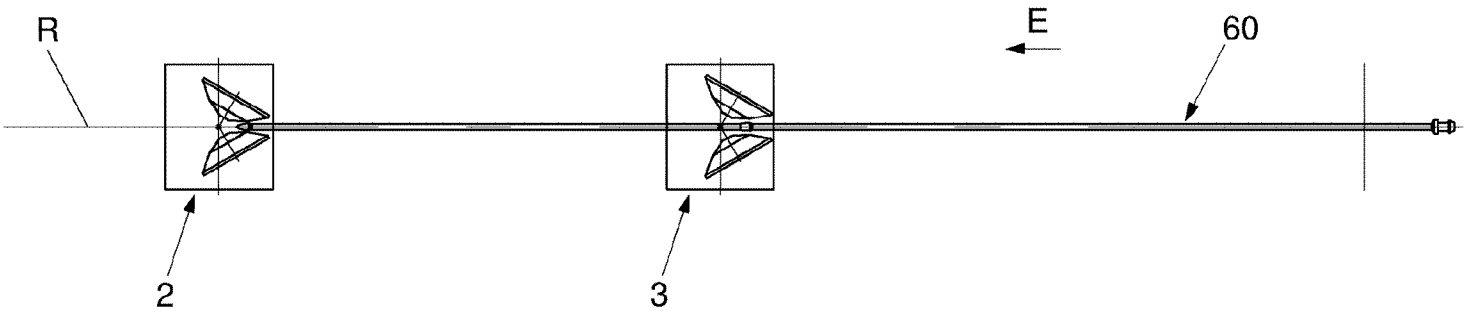

FIG. 4*g* shows the next stake 60 which is aligned with the rolling axis R and is positioned in the finishing stand 3 and of the piercing stand 2 by moving it in the direction of the arrow E and positioning it with the two tips 20 and 21 in the respective working positions in the piercing stand 2 and in the finishing stand 3.

This process is repeated whenever needed, and a cooled, lubricated stake is used for each rolling cycle of each billet; therefore, the rolling mill is provided with the necessary number of stakes to satisfy the rolling capacity of the rolling mill as a function of the operating speed of each tube. In the illustrated example of embodiment, there are two stakes but their number could be higher as a function of machining needs.

Some dimensioning examples of a rolling mill according to the invention are shown below. In the making of a transverse finishing rolling type rolling mill, it is preferable, but not necessary to limit the outlet length of the tube, e.g. within an interval from 12 to 15 meters, rather than making so-called double length tubes, comprised between 24 and 30 meters. As a consequence of this, the length of the product at the outlet of the first piercing stand will be comprised between 8 and 9 meters after piercing, and consequently the length of the billet at the inlet of the piercing stand must be comprised between 5 and 5.5 meters. Starting from billets of such dimensions, it derives that the distance L between the two stands is 9-11 meters.

In a variant embodiment of the rolling mill in which the use of a rotating expander as finishing apparatus is provided at the end of the process, the billet will have an indicative length of 6 meters, producing a pierced product of approximately 12 meters and a finished tube at the outlet of the rolling stand which is approximately 15 meters long. In such case, the distance L between the piercing stand and the rolling stand must be approximately 14 meters. These dimensions are chosen to release the rolling function of the rolling stand 3 from the piercing stand 2, obtaining the following operating and economic advantages:

- low power transformers may be used because one may be certain that the load request of the two stands will not be simultaneous because the stands roll in mutually different times,
- the axial loads on the stake on which the tools are mounted on both piercing and rolling stands are not added up because the gripping of the rolling product by the two stands is not simultaneous;
- there are no operative constraints on the feeding angles of the piercing and rolling stands to the advantage of the possibility of adjusting the rolling torques of the two stands to optimize the dimensions of the stands and of the respective control systems: adapters, reducers, motors;
- there are no operative constraints on the piercing stand and rolling stand motor speed.

The integrated rolling mill as described above allows to implement a piercing and rolling process characterized in that the two steps follow each other in sequence on the same rolling axis without extraction of the stake and the piercing tip downstream of the piercing operation itself; such a sequence allows to develop the first two steps of piercing and rolling in a zone of the shed of limited width, e.g. 21 meters instead of the 36 meters required by a traditional system, with evident economic advantages in terms of mechanical supplies and systems.

A further advantage derives from eliminating inner tool lubrication in the finishing stand and the need to lubricate and deoxidize the inside of the pierced part, with the consequent elimination of the suction hoods and of a fume treatment system. Downstream of the integrated rolling mill the use of a passage induction furnace is provided followed by a calibrator type rolling mill, of the type known in itself. The object of the calibrator is to obtain the required final diameter, while the induction furnace is used both for layout reasons because it allows to maintain the span narrow but also for its flexibility of use because it can be easily adjusted or even switched off, in particular when medium to high thickness products are rolled (18-30 millimeters for example).

A fossil fuel type heating furnace may be used upstream of the calibrator, e.g. of the mobile bar type, instead of the induction furnace, if necessary for the rolling process.

In finishing rolling mills of the rotating expander type, a smoothing machine of the Reeler type may be provided upstream of the final calibration with the purpose of eliminating the waviness of the tube outlet of the expander and to improve the thickness tolerances of the tube itself.

The illustrated method and the rolling mill which implements it thus allow to produce seamless tubes in a simplified system in cost-effective manner with respect to the prior art limiting the transverse dimensions and thus the cost of the civil works of the shed and of the span crane thus reducing the installed electric power and limiting the cost of the equipment because there are no mandrels nor multiple series of rolls for piercing and the finishing rolling mill.

The invention claimed is:

1. A rolling mill with transverse rolling for rolling seamless tubes from a full-section billet, said rolling mill defining a first rolling axis, comprising:

a piercing stand having rolling rolls with respective skewed axes, having a rolling axis thereof coinciding with said first rolling axis, adapted to produce a first tube having a first rolled product length after a piercing operation of said full-section billet, at least one finishing stand having rolling rolls with respective skewed axes, having a rolling axis thereof coinciding with said first rolling axis, adapted to produce a second tube, starting from the first tube, having a second rolled product length after a finishing operation of the first tube, characterized in that the at least one finishing stand is arranged downstream of the piercing stand at a distance equal to or greater than the length of the first rolled product, so that during rolling operations a front end of the first tube may only be gripped by the at least one finishing stand once the rear end of the first tube is no longer gripped by the piercing stand, and in that the rolling mill comprises at least one stake provided with an end tip adapted to pierce and roll the billet, a first portion having a length greater than the length of the first rolled product, an intermediate tip, adapted to roll the first tube to transform it into a second tube, a second portion having a length greater than the length of the second rolled product, wherein a same stake is used for the piercing operation on the piercing stand and also for the finishing operation on the at least one finishing stand.

2. A rolling mill according to claim 1, wherein the piercing stand and the at least one finishing stand have an identical construction.

3. A rolling mill according to claim 2, wherein the at least one finishing stand is arranged along the first rolling axis rotated by 180° about the vertical axis of the stand itself, so that control adapters and corresponding motors of the at least one finishing stand are arranged on the opposite side with respect to the distance which separates the piercing stand from the at least one finishing stand, forming an X-shaped arrangement in plan view.

4. A rolling mill according to claim 3, wherein the piercing stand and the at least one finishing stand are arranged spaced apart with respect to each other.

5. A rolling mill according to claim 1, wherein said rolling mill comprises a calibration stand arranged operatively downstream of said at least one finishing stand.

6. A rolling mill according to claim 5, wherein said calibration stand defines a rolling axis parallel to said rolling axis of said rolling mill.

7. A rolling mill according to claim 1, wherein said rolling mill comprises an axial actuating device of said stake comprising a carriage which moves between a working position and a retracted position to unload said second tube and to replace said stake.

8. A rolling mill according to claim 7, wherein said rolling mill further comprises locking means at said working position adapted to support an axial thrust on said stake and an axial position adjustment means, along said rolling axis of said end tip at said piercing stand and of said intermediate tip at said at least one finishing stand.

9. A rolling mill according to claim 8, wherein said rolling mill further comprises a pair of cooling stations, each adapted to cool one of said tips of said stake at said retracted position.

10. A rolling mill according to claim 7, wherein said rolling mill, further comprises a pair of cooling stations, each adapted to cool one of said tips of said stake at said retracted position.

11. A rolling mill according to claim 1, wherein said rolling mill further comprises a rotating arm stake change system for replacing said stake with another stake between rolling operations.

12. A rolling mill according to claim 1, wherein said rolling mill-comprises a booking system of said stake which starts the rotation of said stake before an inlet of said piercing stand and before the inlet of said at least one finishing stand.

* * * * *